US007900880B2

(12) United States Patent
Connell et al.

(10) Patent No.: US 7,900,880 B2
(45) Date of Patent: Mar. 8, 2011

(54) LIFTING ANCHOR SUPPORT

(75) Inventors: Robert Urquhart Connell, Victoria (AU); Barry William Crone, Balwyn (AU)

(73) Assignee: ITW Construction Products Australia Pty Ltd, Victoria (AU)

( * ) Notice: Subject to any disclaimer, the term of this patent is extended or adjusted under 35 U.S.C. 154(b) by 488 days.

(21) Appl. No.: 11/564,629

(22) Filed: Nov. 29, 2006

(65) Prior Publication Data

US 2007/0176062 A1 Aug. 2, 2007

(30) Foreign Application Priority Data

Nov. 30, 2005 (AU) ..... 2005906706

(51) Int. Cl.
*F16M 11/00* (2006.01)
*E04C 5/16* (2006.01)

(52) U.S. Cl. ..... 248/153; 248/97; 248/164; 248/175; 52/125.2; 52/689; 404/136

(58) Field of Classification Search ..... 248/175, 248/107, 97, 99, 153, 163.1, 164; 52/125.2, 52/125.3, 125.5, 122.1, 689; 404/136
See application file for complete search history.

(56) References Cited

U.S. PATENT DOCUMENTS

| | | | | | |
|---|---|---|---|---|---|
| 619,362 | A * | 2/1899 | Stevenson | 248/175 |
| 1,359,388 | A | 11/1920 | Koerner | |
| 1,499,983 | A * | 7/1924 | Heidrich | 52/689 |
| 1,592,157 | A * | 7/1926 | Reynolds et al. | 52/689 |
| 1,873,471 | A * | 8/1932 | Peterson | 248/524 |
| 1,907,477 | A * | 5/1933 | Bauman | 52/689 |
| 2,218,583 | A * | 10/1940 | Marthaler | 248/188.7 |
| 2,697,574 | A * | 12/1954 | Bricker | 248/149 |
| 3,289,378 | A | 12/1966 | Carroll | |
| 3,610,558 | A * | 10/1971 | Tawara | 47/40.5 |
| 3,659,816 | A * | 5/1972 | Wilson | 248/97 |
| 3,980,320 | A * | 9/1976 | Marchello | 280/293 |
| 4,557,188 | A * | 12/1985 | Spanek | 99/415 |
| 4,613,104 | A * | 9/1986 | Garrott | 248/97 |
| 4,690,357 | A * | 9/1987 | Webster | 248/99 |
| 4,692,050 | A * | 9/1987 | Kaufman | 403/3 |
| 4,875,649 | A * | 10/1989 | Bendig, Jr. | 248/153 |
| 4,953,815 | A * | 9/1990 | Beymer et al. | 248/97 |
| 4,971,277 | A * | 11/1990 | Tedham et al. | 248/175 |
| 7,032,868 | B2 * | 4/2006 | Mutert | 248/99 |
| 7,422,187 | B2 * | 9/2008 | Traut | 248/431 |

* cited by examiner

*Primary Examiner* — Anita M King
(74) *Attorney, Agent, or Firm* — Lowe, Hauptman, Ham & Berner, LLP

(57) ABSTRACT

A support stand for a lifting anchor to be incorporated into a concrete component during casting thereof is formed from two identical components of bent wire assembled together to form an upper support frame and legs projecting downwardly from the frame. The two components are connected by only two welds, each at one of two zones of intersection of the two components.

8 Claims, 11 Drawing Sheets

LIFTING ANCHOR SUPPORT

RELATED APPLICATIONS

The present application is based on, and claims priority from, Australian Application Number 2005906706, filed Nov. 30, 2005, the disclosure of which is hereby incorporated by reference herein in its entirety.

BACKGROUND OF THE INVENTION

1. Field of the Invention

The present invention relates to a support for setting a cast-in lifting anchor into a concrete component.

2. Description of the Prior Art

Conventionally, concrete components such as beams, panels, and slabs which require to be lifted during erection will incorporate lifting anchors to provide lifting points for the component, the anchors being incorporated into the component at the time of casting. For slabs or panels which are cast on-site for erection by a face-lift tilt-up lifting action for movement between a flat or horizontal orientation in which the component is cast to a vertical orientation, the lifting anchors, known as face-lift anchors, are supported from the bed on which the component is cast. The head of the anchor is received within a void former which will lie adjacent to the upper surface of the cast component so that when the void former is removed after casting the head of the lifting anchor will lie within the void thus formed for attachment to appropriate lifting equipment. One prior form of support for holding the anchor and void former during casting for this purpose is in the form of a wire stand which engages with the void former attached to the head of the anchor and has projecting legs which extend downwardly beyond the foot of the anchor to rest on the casting bed and hold the foot of the anchor above the bed. These prior forms of support stand usually consist of an upper ring which surrounds and engages the void former and several legs connected to the ring by welding and projecting downwardly from the ring. For stability the legs are each bent into a relatively complex shape so that the legs meet or intersect in a lower part of the structure where they are tied together, before extending outwardly into foot portions which rest on the bed.

SUMMARY OF THE INVENTION

The present invention seeks to simplify the design of such support stands by reducing the number of component parts and thereby reducing the number of welding operations needed in assembly.

According to the present invention there is provided a support stand for a void former and lifting anchor assembly to be cast into a concrete component, the support stand being formed from two components of bent wire which, when assembled together, define an upper frame from which the void former can be supported with the body of the anchor being suspended beneath the void former and legs projecting downwardly from the frame to rest on a bed on which the component is cast.

Advantageously, the two wire components are connected by just two welds each at one of two zones of intersection of the two components.

Advantageously, the two components are of identical shape. It is also advantageous for the number of bends in each component to be kept to a minimum.

Further according to the invention, there is provided a support stand for an anchor to be cast into a concrete component, the support stand being formed from two identical components of bent wire welded together to form an open upper frame from which the anchor is supported and legs projecting downwardly from the frame to rest on a bed on which the concrete component is cast.

BRIEF DESCRIPTION OF THE DRAWINGS

Embodiments of the invention will now be described by way of example only with reference to the accompanying drawings in which.

DESCRIPTION OF THE PREFERRED EMBODIMENTS

Figure 1:
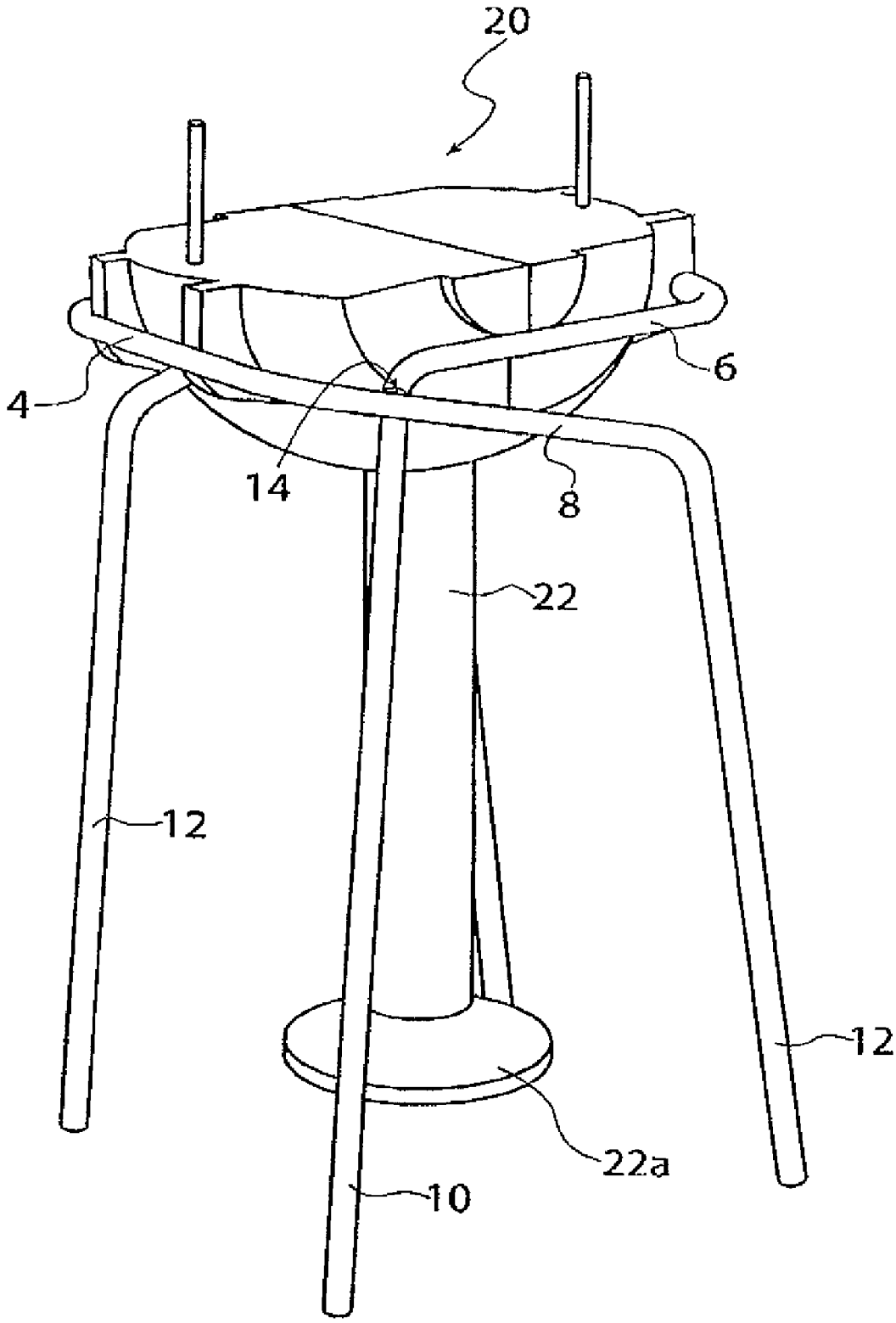
FIG. 1 is a perspective view showing a support stand in accordance with an embodiment of the invention and showing also a void former and lifting anchor assembly carried by the stand by cooperation between an upper frame within the stand and the void former.
Figure 2:
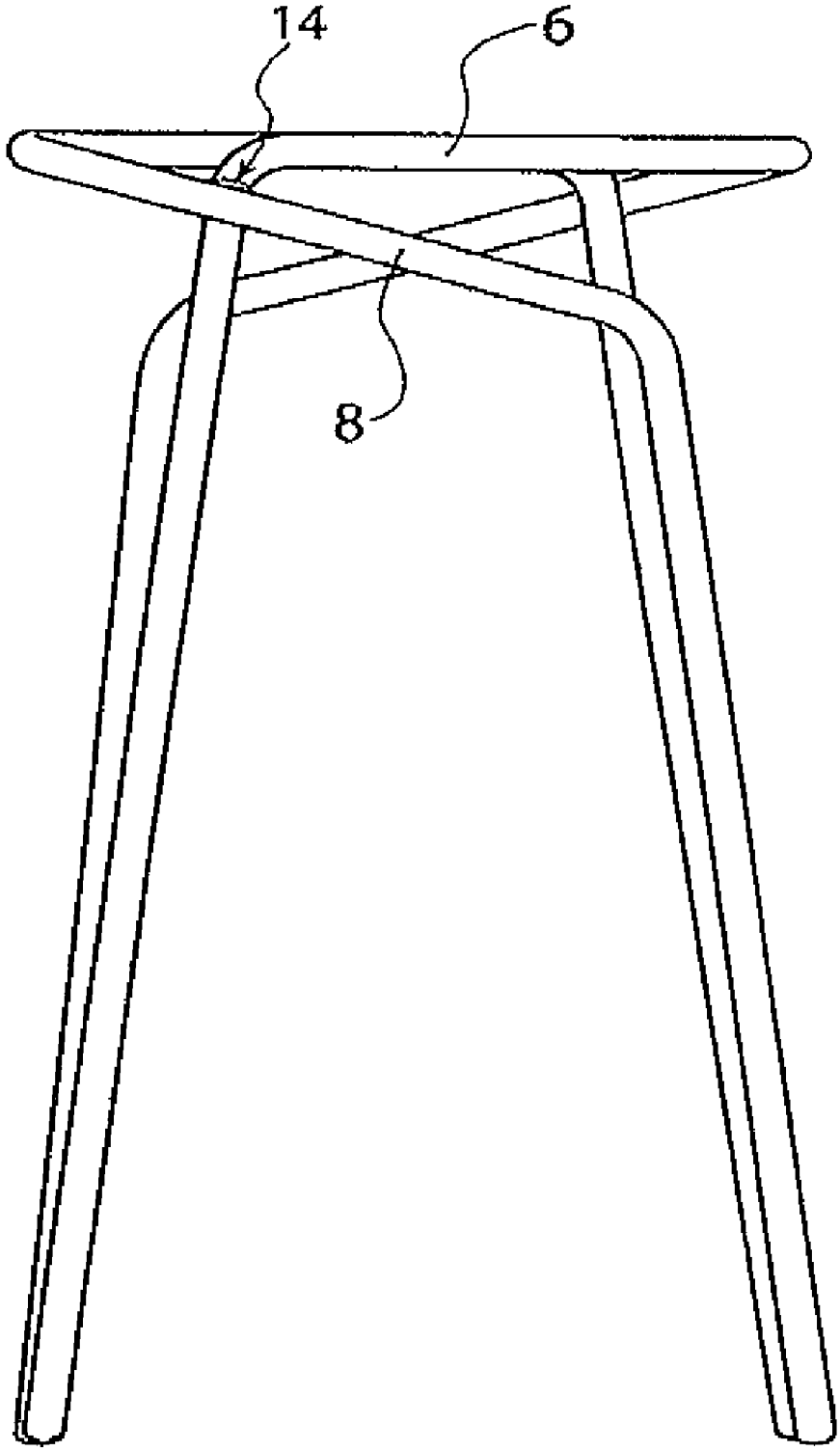
FIG. 2 is a side view of the stand shown in FIG. 1.
Figure 3:
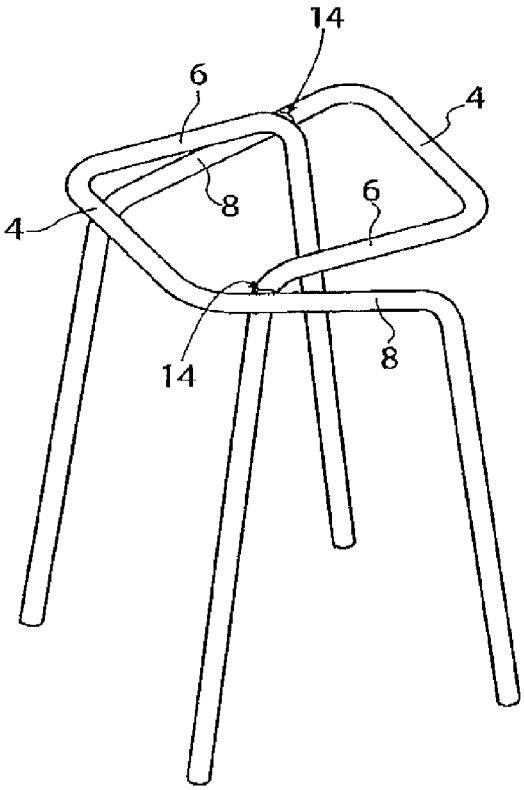
FIG. 3 is a perspective view of the stand shown in FIG. 1.
Figure 4:
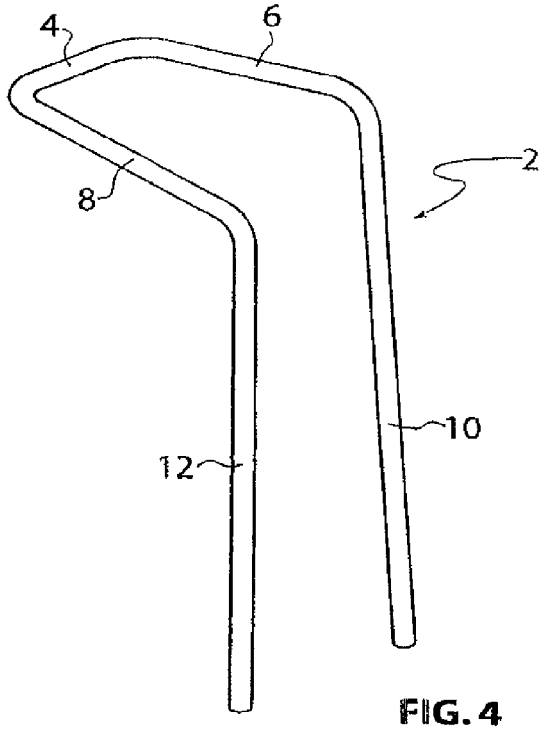
FIG. 4 is a perspective view of one of the two identical bent wire components used for assembling the stand.
Figure 5:
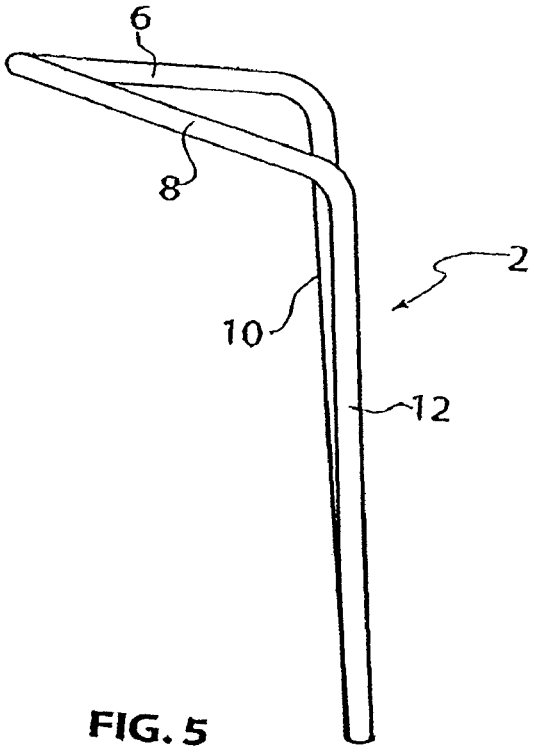
FIG. 5 is a side view equivalent to FIG. 4.
Figure 6:
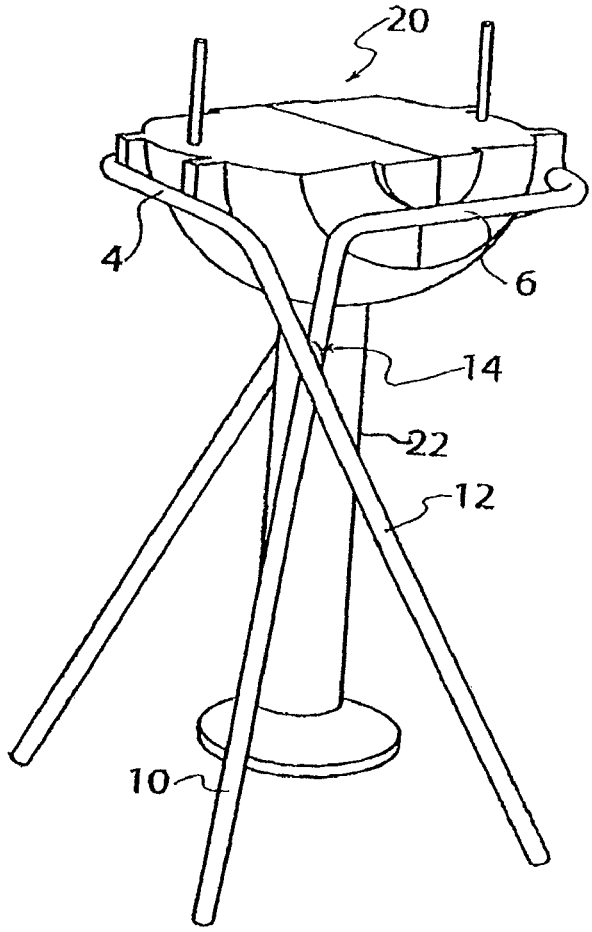
FIGS. 6 to 10 are views corresponding to FIGS. 1 to 5 showing a variant.
Figure 7:
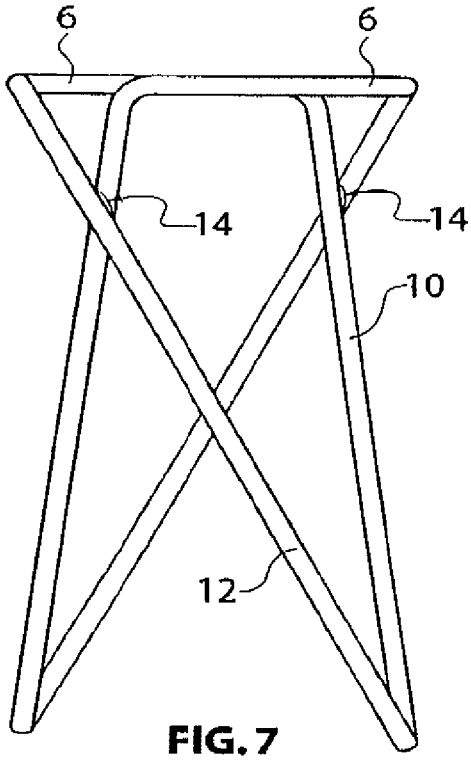
Figure 8:
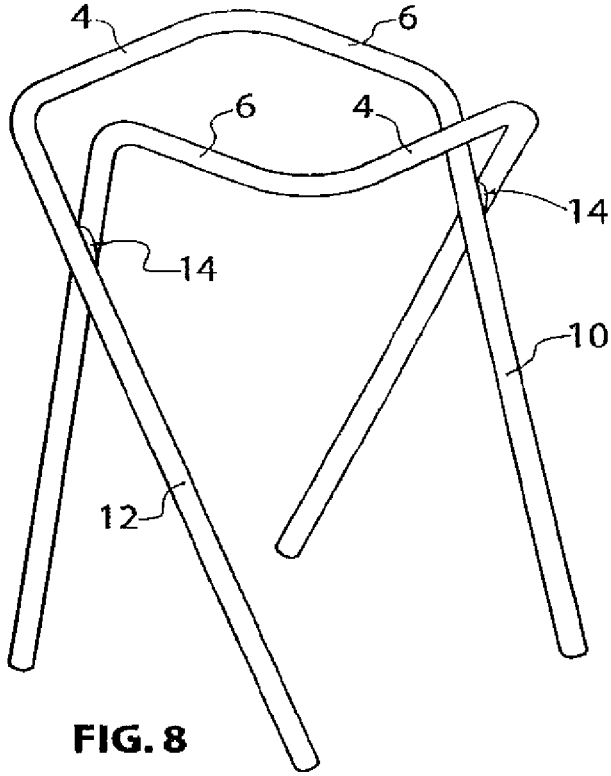
Figure 9:
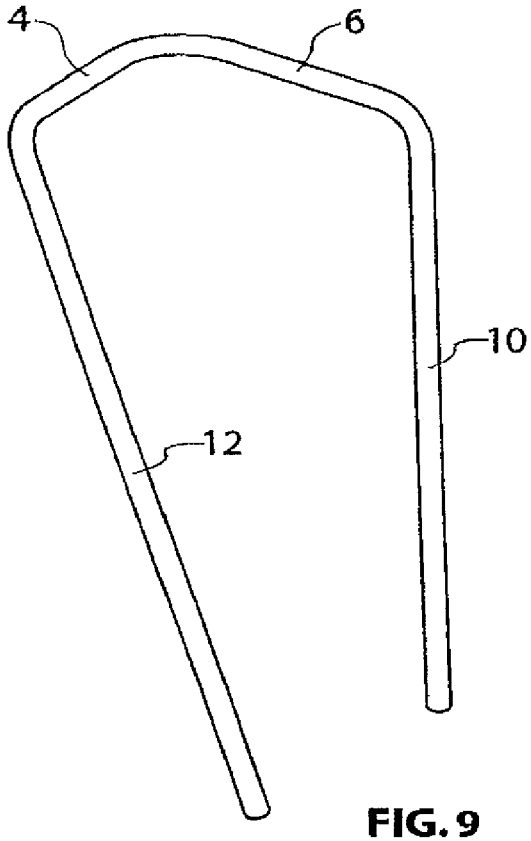
Figure 10:
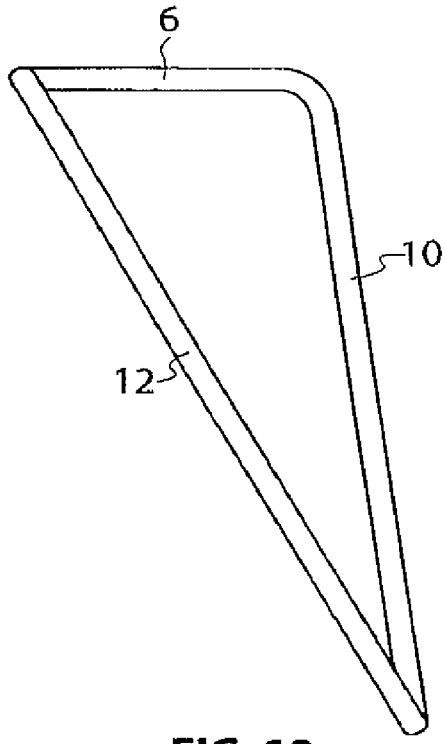
Figure 11:
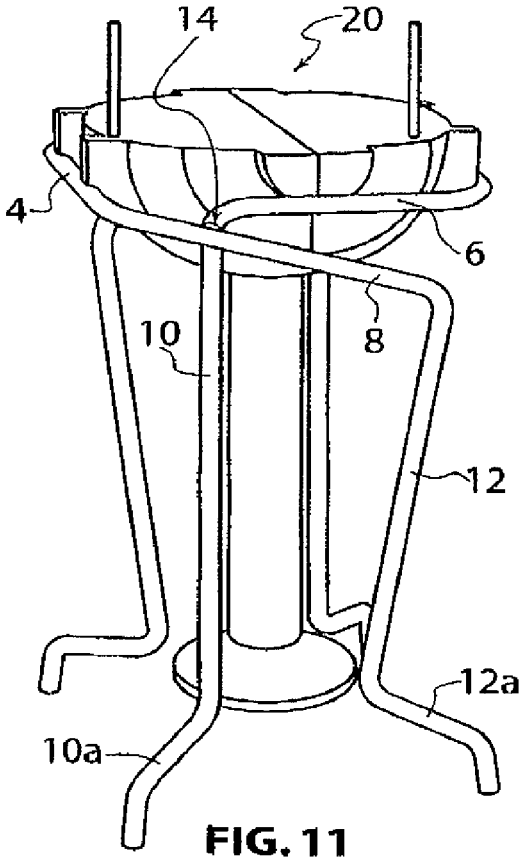
FIGS. 11 to 15 are views corresponding to FIGS. 1 to 5 showing a further variant.
Figure 12:
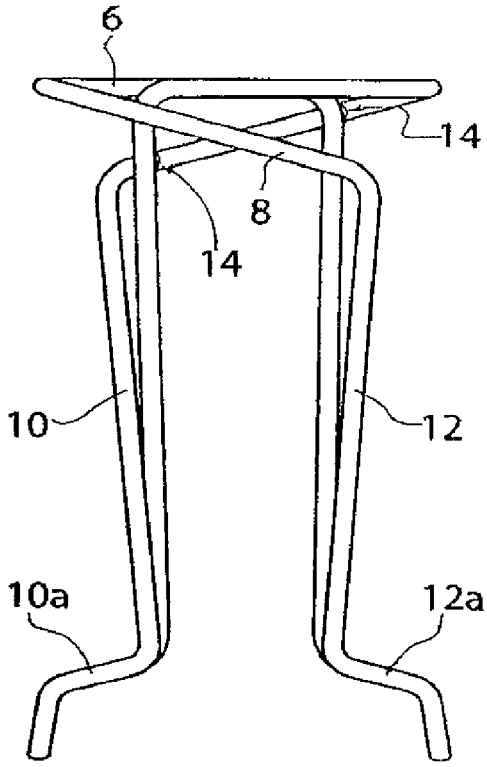
Figure 13:
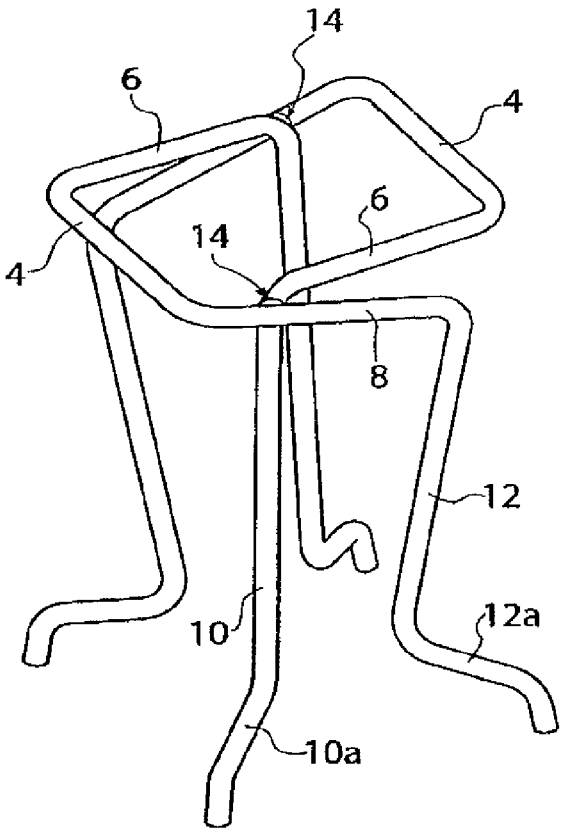
Figure 14:
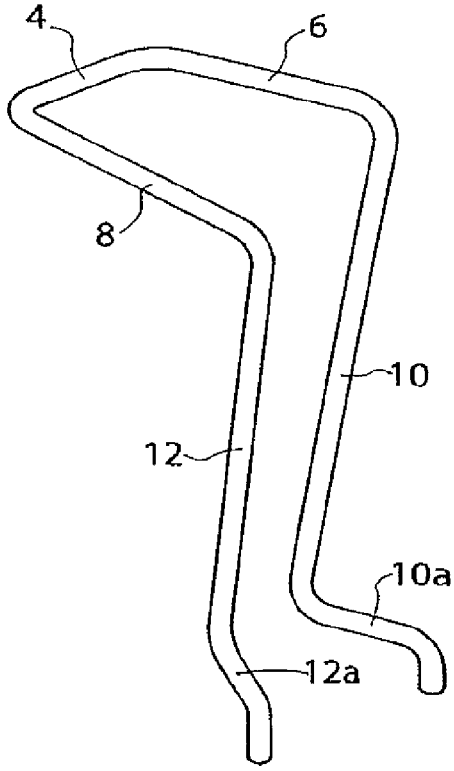
Figure 15:
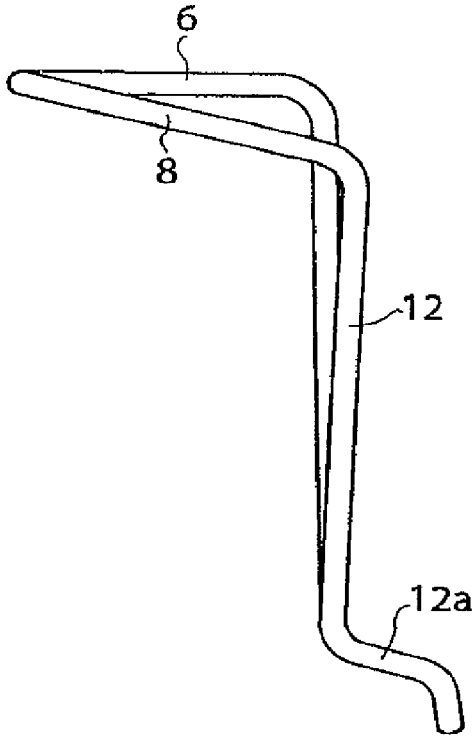
Figure 16:
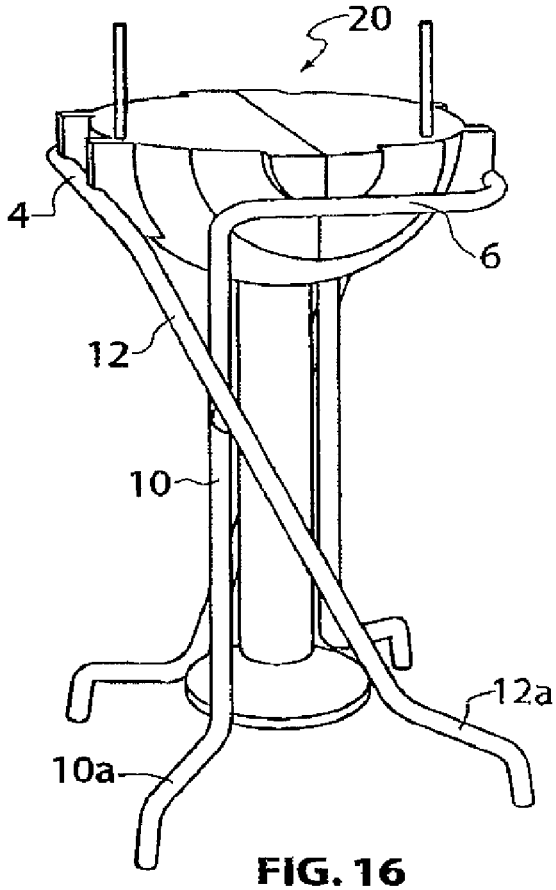
FIGS. 16 to 20 are views corresponding to FIGS. 1 to 5 showing a yet further variant.
Figure 17:
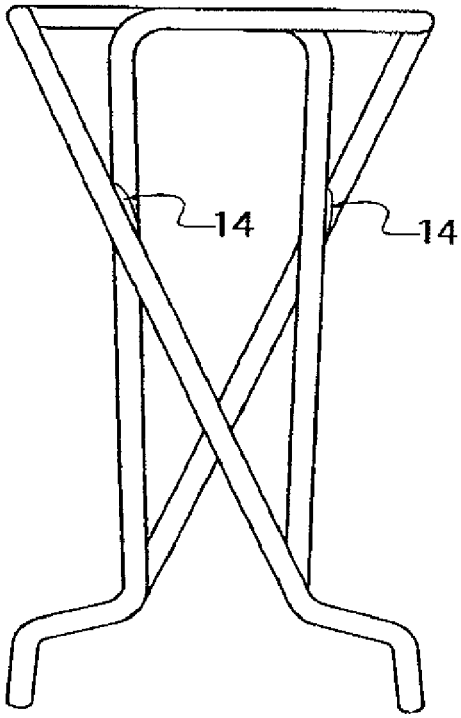
Figure 18:
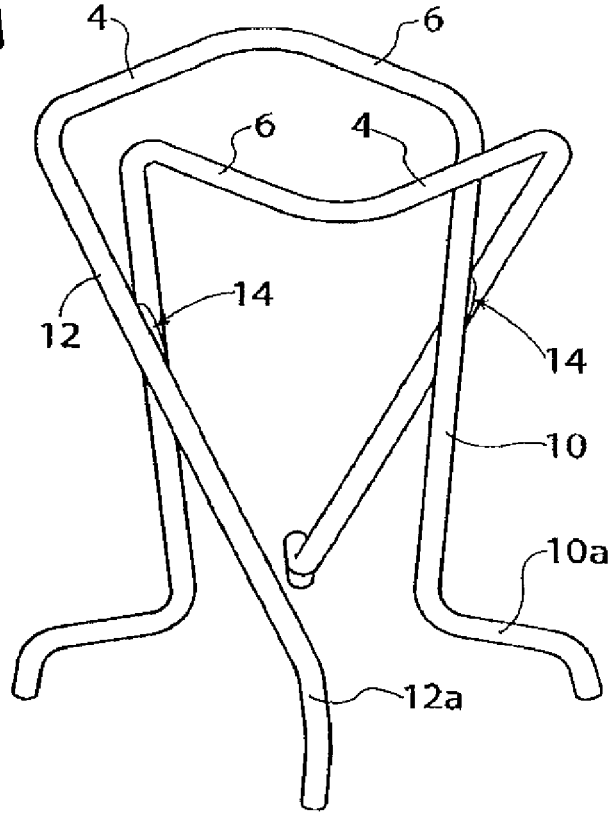
Figure 19:
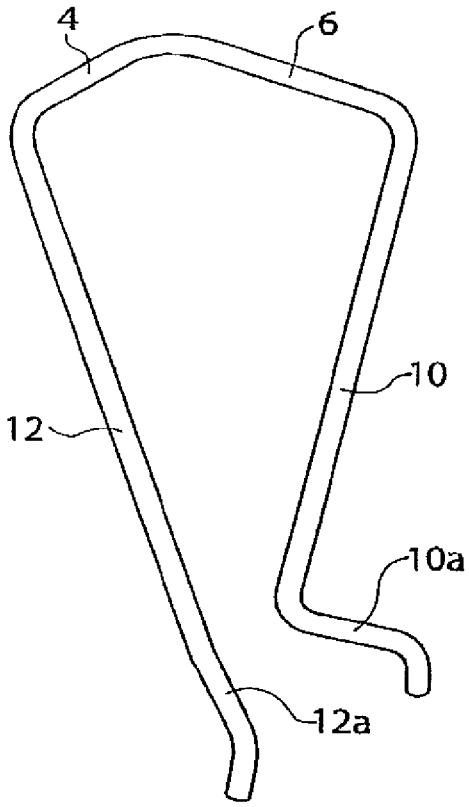
Figure 20:
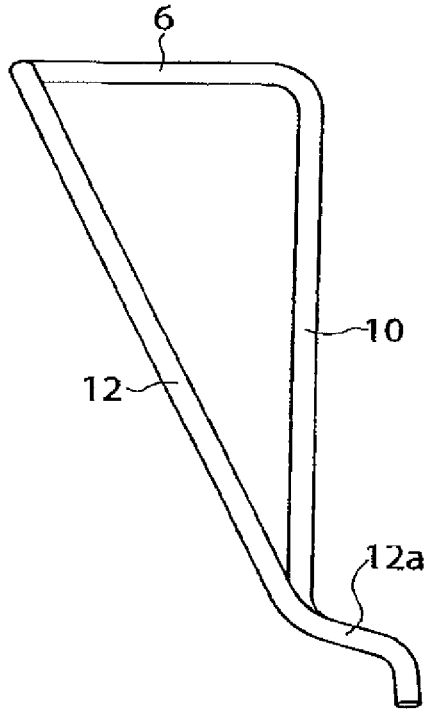

The support stand shown in FIGS. 1 to 5 consists of two identical components 2 each shaped by bending from a single piece of wire as shown in FIGS. 4 and 5. This provides at the upper end a central horizontal support bar 4 with a lateral bar 6, 8 extending from each end of the support bar 4 and then extending downwardly to form a leg 10, 12. It will be seen that the lateral bar 6 extends substantially horizontally from the support bar 4 whereas the bar 8 is somewhat inclined and this is readily visible in the side view of FIG. 5. The two components 2 are assembled in intersecting relationship as shown in FIG. 3 and are welded together at their two zones of intersection designated 14. In the assembled condition the central bars 4 and horizontal lateral bars 6 of the two components 2 cooperate to define a generally rectangular frame with horizontal sides into which the void former 20 can engage and be supported as shown in FIG. 1. In this condition, the head of the lifting anchor 22 is releasably locked within the void former 20 so that, effectively, the anchor 22 is suspended from the void former 20, with its foot portion 22*a* above the level of the casting bed on which the stand rests.

Accordingly in this embodiment the support stand is fabricated from two identical wire components each bent to required shape, in this particular case with four bends per component, with just two welds being needed to connect the components.

In the variant shown in FIGS. 6 to 10, the shaping of the upper part of each component 2 is changed somewhat, mainly by the elimination of the lateral bar 8, to permit the generally rectangular supporting frame defined in the assembled structure to be formed with only three bends per component.

FIGS. 11 to 15 show a variation to the version shown in FIGS. 1 to 5 in which the legs 10, 12 are initially splayed inwardly and at their outer ends are bent outwardly and downwardly to define foot portions 10*a*, 12*a*. Although each component requires more bends than that used in the version of FIGS. 1 to 5 (eight bends rather than four) nevertheless this form may be desirable in some situations to facilitate improved cooperation with the reinforcement which is laid prior to casting.

FIGS. 16 to 20 show a similar variant of the version of FIGS. 6 to 10 in which the legs 10, 12 have a reduced outwards splay and at their lower end portions are then bent outwardly and downwardly to define foot portions 10*a*, 12*a*. In this version seven bends per component are required.

In each of the embodiments described herein the support stand is assembled from just two identical components with only two welds being required, thereby simplifying and reducing the cost of the assembly.

The embodiments have been described by way of example only and modifications are possible within the scope of the invention.

The invention claimed is:

1. A support stand comprising:

an upper support frame formed by a pair of intersecting rods, the pair of rods connected at two points;

wherein each rod includes:

a central horizontal support bar, a first lateral bar and a second lateral bar; and a pair of legs extending from ends of the first and second lateral bars, respectively, wherein the first lateral bar extends substantially horizontally from the central horizontal support bar, and the second lateral bar is inclined with respect to the central horizontal support bar.

2. The support stand according to claim 1, wherein the two rods are of identical shape.

3. The support stand according to claim 2, wherein the upper support frame is of generally rectangular shape and extends substantially horizontally.

4. The support stand according to claim 3, wherein each rod provides one side of the upper support frame and at least a substantial part of a further side extending from an end of said one side transversely thereto.

5. The support stand according to claim 3, wherein the rods intersect at zones closely adjacent to the upper support frame.

6. The support stand according to claim 3, wherein the rods intersect at an area defined by a bottom portion of each rod.

7. The support stand according to claim 3, wherein bottom portions of the legs are bent outwardly and downwardly to form foot portions.

8. A support stand comprising:

a pair of rods connected at two points, the connected pair of rods forming an upper support frame;

wherein each rod comprises:

an upper frame portion having two coplanar and contiguous segments;

a pair of legs extending from ends of the upper frame portion;

wherein a portion of one leg of the pair of legs is inclined with respect to the upper frame portion to define a lateral bar, and said lateral bar is angled with respect to a remaining portion of the leg.

* * * * *